US006321717B1

(12) United States Patent
Faletti

(10) Patent No.: US 6,321,717 B1
(45) Date of Patent: Nov. 27, 2001

(54) DOUBLE-LIFT EXHAUST PULSE BOOSTED ENGINE COMPRESSION BRAKING METHOD

(75) Inventor: James J. Faletti, Spring Valley, IL (US)

(73) Assignee: Caterpillar Inc., Peoria, IL (US)

( * ) Notice: Subject to any disclaimer, the term of this patent is extended or adjusted under 35 U.S.C. 154(b) by 0 days.

(21) Appl. No.: 09/504,491

(22) Filed: Feb. 15, 2000

(51) Int. Cl.[7] ..... F02D 13/04; F01L 13/06
(52) U.S. Cl. ..... 123/321; 123/322
(58) Field of Search ..... 123/90.15, 321, 123/322

(56) References Cited

U.S. PATENT DOCUMENTS

| | | | |
|---|---|---|---|
| 4,981,119 | 1/1991 | Neitz et al. . | |
| 5,146,890 | 9/1992 | Gobert et al. . | |
| 5,406,918 | 4/1995 | Joko et al. | 123/321 |
| 5,485,819 * | 1/1996 | Joko et al. | 123/321 |
| 5,546,914 | 8/1996 | Scheinert | 123/568.14 |
| 5,564,386 | 10/1996 | Korte et al. | 123/321 |
| 5,595,158 | 1/1997 | Faletti et al. | 123/321 |
| 5,603,300 | 2/1997 | Feucht et al. | 123/322 |
| 5,615,653 | 4/1997 | Faletti et al. | 123/322 |
| 5,626,116 | 5/1997 | Reedy et al. | 123/321 |
| 5,645,031 | 7/1997 | Meneely | 123/322 |
| 5,724,939 | 3/1998 | Faletti et al. | 123/322 |
| 6,000,374 * | 12/1999 | Cosma et al. | 123/321 |

FOREIGN PATENT DOCUMENTS 63-272929 * 11/1988 (JP) .

* cited by examiner

*Primary Examiner*—Tony M. Argenbright
(74) *Attorney, Agent, or Firm*—Marshall, O'Toole, Gerstein, Murray & Borun

(57) ABSTRACT

A method of compression braking is provided for use in an internal combustion engine having a plurality of combustion chambers that share a common exhaust manifold, such as, for example, a six-cylinder engine. The method comprises the steps of moving each exhaust valve to an open position at a first time corresponding to approximately the beginning of the power portion of the cycle of the combustion chamber associated with the exhaust valve and moving each exhaust valve to the open position at a second time corresponding to approximately the end of the intake portion of the cycle of the combustion chamber associated with the exhaust valve.

3 Claims, 7 Drawing Sheets

DOUBLE-LIFT EXHAUST PULSE BOOSTED ENGINE COMPRESSION BRAKING METHOD

TECHNICAL FIELD

The present invention relates generally to engine retarding methods and, more particularly, to a method for engine compression braking.

BACKGROUND ART

Engine brakes or retarders are used to assist and supplement wheel brakes in slowing heavy vehicles, such as tractor-trailers. Engine brakes are desirable because they help alleviate wheel brake overheating. As vehicle design and technology have advanced, the hauling capacity of tractor-trailers has increased, while at the same time rolling resistance and wind resistance have decreased. Thus, there is a need for advanced engine braking systems in today's heavy vehicles.

Known engine compression brakes convert an internal combustion engine from a power generating unit into a power consuming air compressor.

U.S. Pat. No. 3,220,392 issued to Cummins on Nov. 30, 1965, discloses an engine braking system in which an exhaust valve located in a cylinder is opened when the piston in the cylinder nears the top dead center (TDC) position on the compression stroke. An actuator includes a master piston, driven by a cam and pushrod, which in turn drives a slave piston to open the exhaust valve during engine braking. The braking that can be accomplished by the Cummins device is limited because the timing and duration of the opening of the exhaust valve is dictated by the geometry of the cam which drives the master piston and hence these parameters cannot be independently controlled.

In an effort to maximize braking power, engine braking systems have been developed that use both the compression stroke and what would normally be the exhaust stroke of the engine in a four-cycle powering mode to produce two compression release events per engine cycle. Such systems are commonly referred to as two-cycle retarders or two-cycle engine brakes and are disclosed, for example, in U.S. Pat. No. 4,592,319 issued to Meistrick on Jun. 3, 1986, and in U.S. Pat. No. 4,664,070 issued to Meistrick et al. on May 12, 1987. The Meistrick et al. '070 patent also discloses an electronically controlled hydro-mechanical overhead which operates the exhaust and intake valves and is substituted in place of the usual rocker arm mechanism for valve operation.

A method of two-cycle exhaust braking using a butterfly valve in an exhaust pipe or manifold in combination with opening an exhaust valve at both the beginning and the end of the compression stroke is disclosed in U.S. Pat. No. 4,981,119 issued to Neitz et al. on Jan. 1, 1991.

In a further effort to maximize braking power, systems have been developed which open the exhaust valves of each cylinder during braking for at least part of the downstroke of the associated piston. In this manner, pressure released from a first cylinder into the exhaust manifold is used to boost the pressure of a second cylinder. Thereafter, the pressure in the second cylinder is further increased during the upstroke of the associated piston so that retarding forces are similarly increased. This mode of operation is termed "back-filling" and systems employing this mode of operation are disclosed in the Meistrick '319 patent and in U.S. Pat. No. 4,741,307 issued to Meneely on May 3, 1988.

U.S. Pat. No. 5,526,784 issued to Hakkenberg et al. on Jun. 18, 1996, and assigned to the assignee of the present invention, discloses a system and method for compression braking of a multi-cylinder engine that uses simultaneous opening of all exhaust valves of the engine. The system and method of the Hakkenberg et al. '784 patent, when implemented in a multi-cylinder engine such as, for example, a 6-cylinder engine, provides higher cylinder pressures in cylinders still in the early stages of a compression stroke when the exhaust valves are opened, thereby allowing the cylinder pressure to build up and increase the braking function.

U.S. Pat. No. 5,724,939, issued to Faletti et al. on Mar. 10, 1998, and assigned to the assignee of the present invention, discloses two-cycle and four-cycle methods of compression braking for an internal combustion engine. In accordance with the method disclosed in the Faletti et al. '939 patent, exhaust valves are opened in cylinders wherein associated pistons are near TDC and substantially simultaneously, exhaust valves are opened in cylinders wherein associated pistons are nominally past bottom dead center (BDC). This provides an advantageous braking power increase due to back-filling of the cylinders wherein associated pistons are nominally past BDC.

DISCLOSURE OF THE INVENTION

Applicant has discovered that a desirable method of back-filling for an engine braking system is to open each exhaust valve in each cylinder at a first time at approximately the beginning of the power stroke and at a second time at approximately the end of the intake stroke. This method provides additional braking power resulting from back-filling of each cylinder, and simulations indicate that an increase of braking power of approximately 20% is provided by the method of the present invention, as compared to braking without back-filling.

In accordance with one aspect of the present invention, a method of compression braking is provided for use in an internal combustion engine having a plurality of combustion chambers. Each combustion chamber operates in a cycle comprising intake, compression, power and exhaust portions, and each combustion chamber is in flow communication with an exhaust valve movable between an open position and a closed position for selectively placing each combustion chamber in flow communication with a common exhaust manifold. The method comprises the steps of moving each exhaust valve to the open position at a first time corresponding to approximately the beginning of the power portion of the cycle of the combustion chamber associated with the exhaust valve and moving each exhaust valve to the open position at a second time corresponding to approximately the end of the intake portion of the cycle of the combustion chamber associated with the exhaust valve.

In accordance with another aspect of the present invention, each portion of the cycle of the internal combustion engine comprises 180 degrees of crank angle rotation and the step of moving each exhaust valve to the open position at the first time includes a step of holding the exhaust valve open from approximately the beginning of the power portion of the cycle of the combustion chamber associated with the exhaust valve to a crank angle of about 80 degrees after the beginning of the power portion of the cycle of the combustion chamber associated with the exhaust valve.

In accordance with yet another aspect of the present invention, the step of moving each exhaust valve to the open position at the second time includes a step of holding the exhaust valve open from a crank angle of about 120 degrees after the beginning of the intake portion of the cycle of the combustion chamber associated with the exhaust valve to a crank angle of about 30 degrees after the beginning of the compression portion of the cycle of the combustion chamber associated with the exhaust valve.

Other features and advantages are inherent in the method claimed and disclosed or will become apparent to those skilled in the art from the following detailed description in conjunction with the accompanying drawings.

BEST MODE FOR CARRYING OUT THE INVENTION

Figure 1:
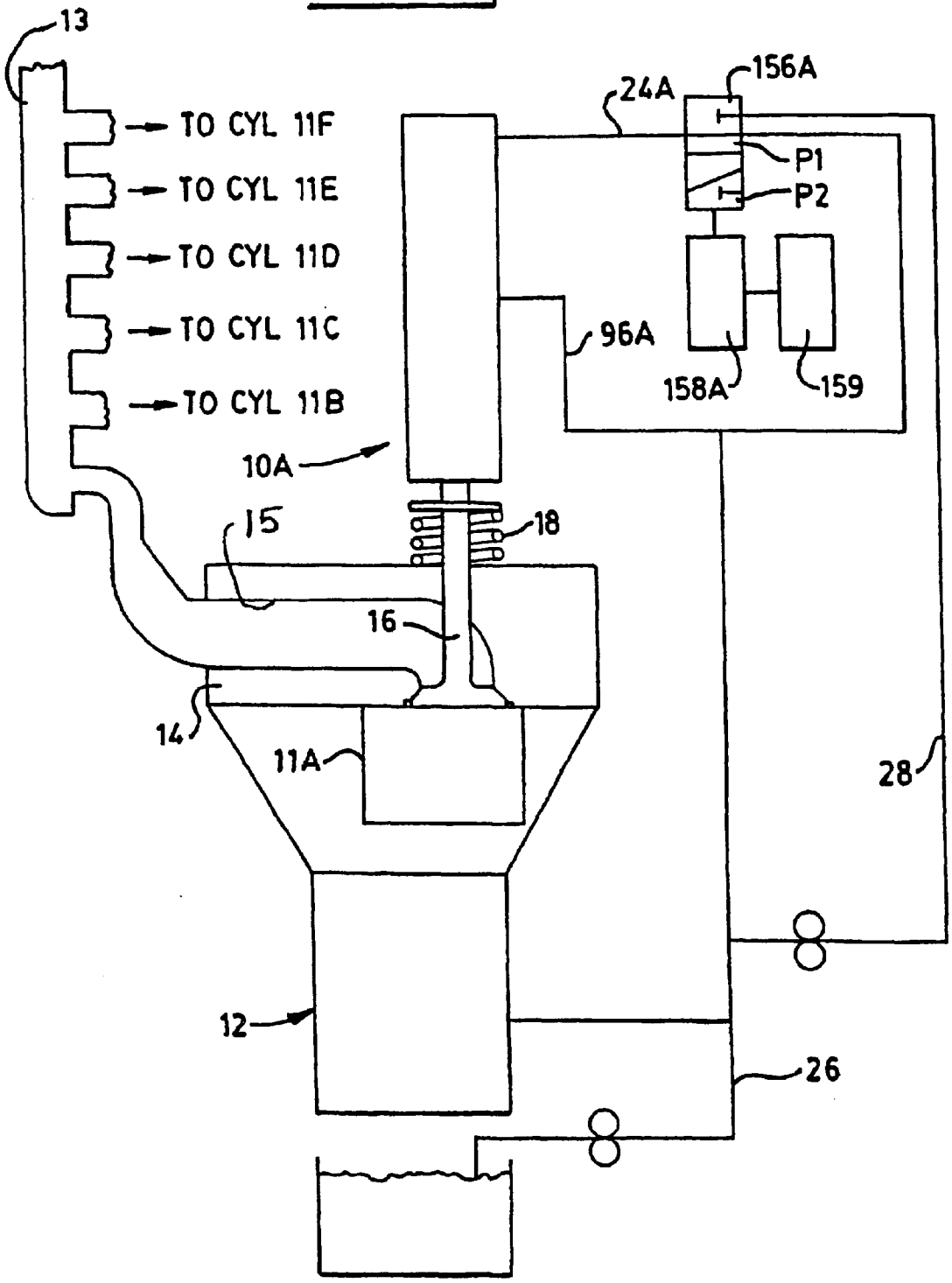
FIG. 1 is a block diagram of an exhaust valve actuation system capable of carrying out the method of the present invention.
Figure 2:
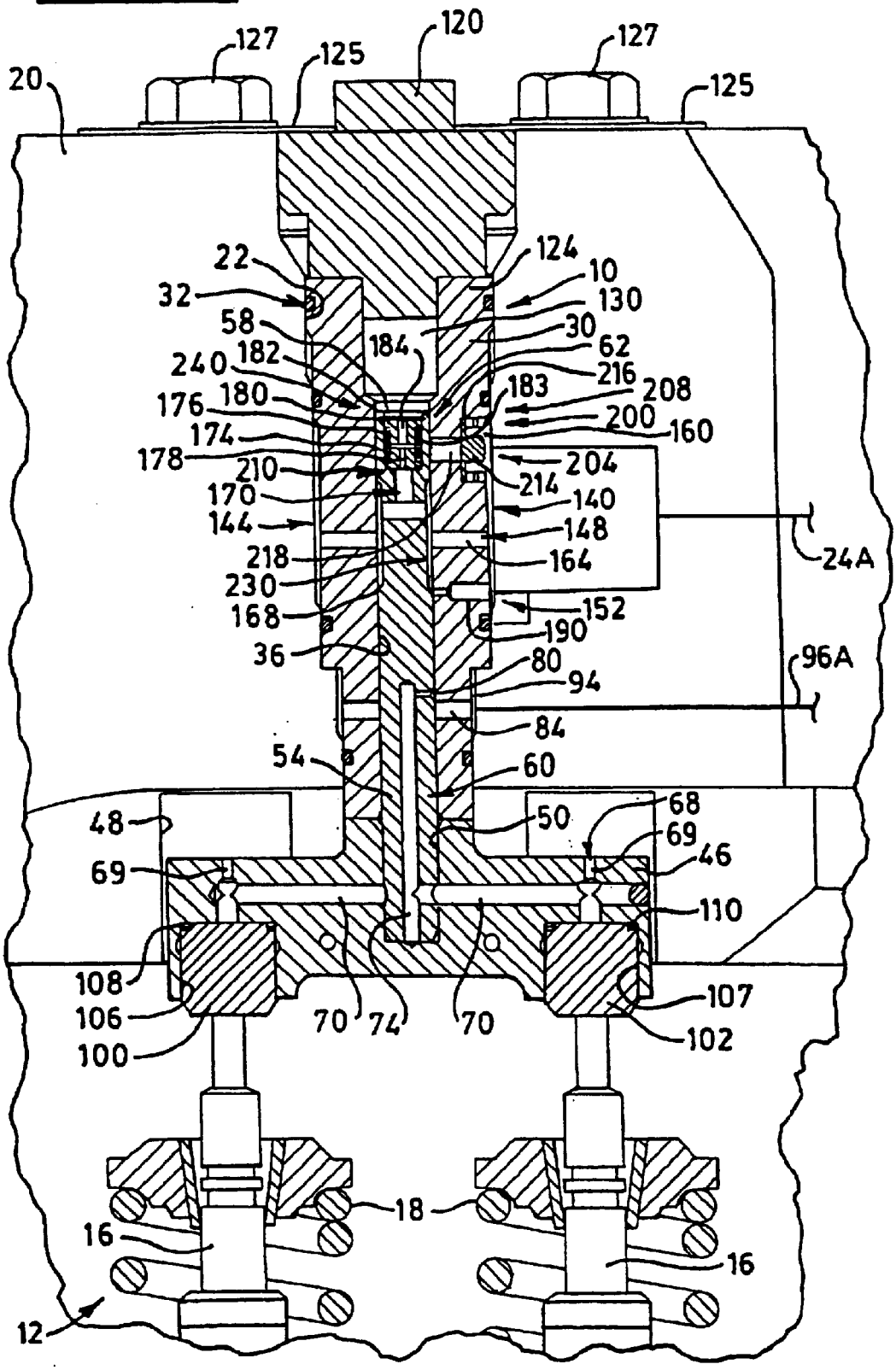
FIG. 2 is a diagrammatic partial sectional view of the valve actuation system of FIG. 1 showing the exhaust valves in a closed position.
Figure 3:
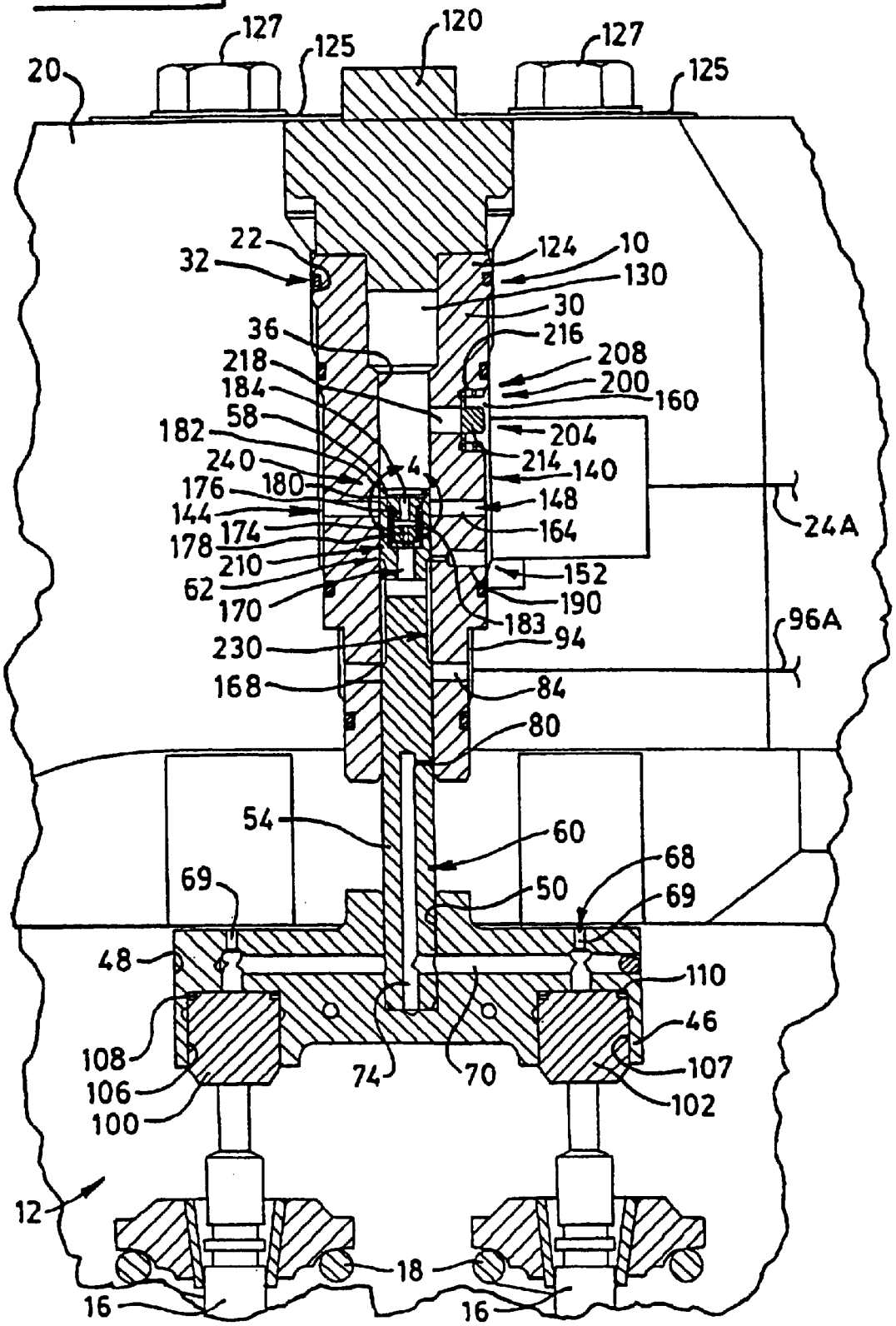
FIG. 3 is a view similar to FIG. 2, showing the exhaust valves in an open position.
Figure 4:
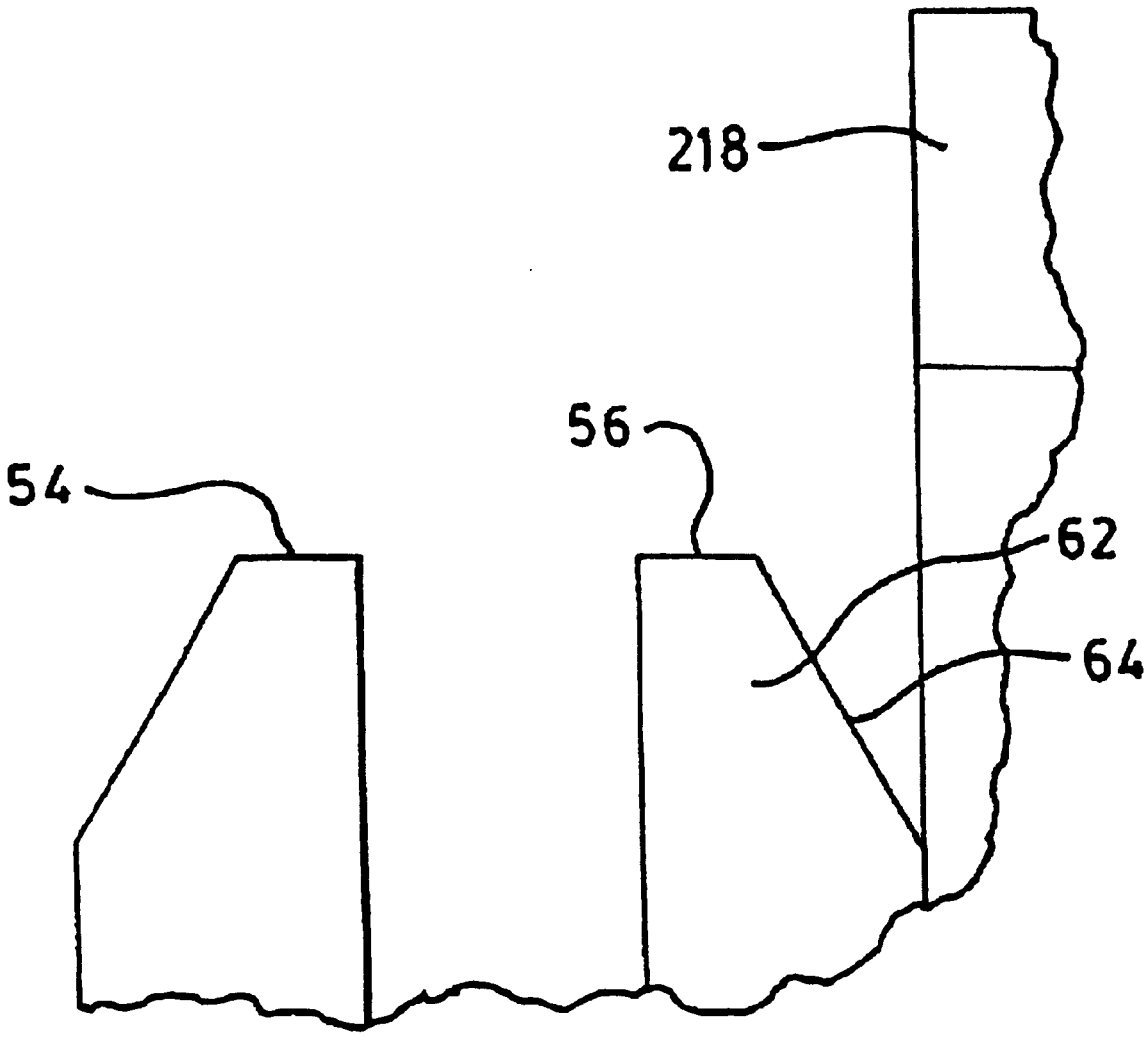
FIG. 4 is an exaggerated enlarged detail view encircled by 4—4 of FIG. 3.

The present invention will now be described with reference to FIGS. 1–5 that show an apparatus capable of carrying out the method of the present invention, which comprises an exhaust valve actuation system 10A, associated with a cylinder 11A of a six-cylinder, four-cycle internal combustion engine 12. For clarity, only the valve actuation system 10A, associated with cylinder 11A is shown in FIGS. 1–3, as the components and operation thereof are identical to those of valve actuation systems 10B, 10C, 10D, 10E and 10F that are associated with cylinders 11B, 11C, 11D, 11E and 11F, respectively. The engine 12 has a cylinder head 14 and one or more engine exhaust valve(s) 16 associated with each cylinder and reciprocally disposed within the cylinder head 14. The exhaust valves 16 are only partially shown in FIGS. 2 and 3 and are movable between a first or closed position, shown in FIG. 2, and a second or open position, shown in FIG. 3. The valves 16 are biased toward the first position by any suitable means, such as by helical compression springs 18. Each valve 16, when open, places an associated engine cylinder 11A, 11B, 11C, 11D, 11E or 11F in fluid communication with a common exhaust manifold 13 via an exhaust port 15.

An actuator head 20 has an axially extending bore 22 therethrough of varying diameters. Additionally, the actuator head 20 has a rail passage 24A therein which may be selectively placed in fluid communication with either a low pressure fluid source 26 or a high pressure fluid source 28, both of which are shown in FIG. 1. The pressure of the fluid from the high pressure fluid source 26 is greater than 1500 psi, and more preferably, greater than 3000 psi. The pressure of the fluid from the low pressure fluid source is preferably less than 400 psi, and more preferably, less than 200 psi.

A cylindrical body 30 (FIG. 2) is sealingly fitted within the bore 22 by a plurality of O-rings 32 and has an axially extending bore 36.

A bridge member 46 is disposed within a recess 48 in the actuator head 20 adjacent to the body 30. The bridge 46 has a bore 50 of predetermined length which is coaxially aligned with the bore 36 in the body 30.

A plunger 54 includes a plunger surface 58 and includes an end portion 60 secured within the bore 50 of the bridge 46. A second end 62 of the plunger 54 is slidably disposed within the bore 36 of the body 30. The second end 62 of the plunger 54 has a frusto-conical shape 64 which diverges from the plunger surface 58 at a predetermined angle which can be seen in more detail in FIG. 4. The plunger 54 may be integrally formed with or separately connected to the bridge 46, such as by press fitting. The plunger 54 is operatively associated with the valves 16 and is movable between a first position and a second position. The movement of the plunger 54 toward the second position moves the valves 16 to the open position. It should be understood that the plunger 54 may be used to directly actuate the exhaust valves 16 without the use of a bridge 46. In this manner, the plunger 54 would be integrally formed with or separately positioned adjacent the exhaust valves 16 such that the valves 16 are engaged when the plunger 54 is moved to the second position.

A means 68 for communicating low pressure fluid into the bridge 46 is provided. The communicating means 68 includes a pair of orifices 69 disposed within the bridge 46 and a pair of connecting passages 70 extending through the orifices 69 and the bridge 46 and into the plunger 54. A longitudinal bore 74 extends through a portion of the plunger 54 and is in fluid communication with the connecting passages 70 within the bridge 46. An orifice 80 extends outwardly from the longitudinal bore 74. A cross bore 84 extends through the body 30 at a lower end 90. The cross bore 84 is connected to a lower annular cavity 94 defined between the body 30 and the actuator head 20. The lower annular cavity 94 is in communication with the low pressure fluid source 26 through a passage 96A in the actuator head 20. As discussed in further detail below, the cross bore 84 has a predetermined position relative to the orifice 80 such that the orifice 80 is in fluid communication with the low pressure fluid source 26 through the passage 96A when the plunger 54 begins to move from the first position to the second position.

A pair of hydraulic lash adjusters 100, 102 are secured within a pair of large bores 106, 107, respectively, in the bridge 46 by any suitable means, such as a pair of retaining rings 108, 110. The lash adjusters 100, 102 are in fluid communication with the orifices 69 and the connecting passages 70 and are adjacent the exhaust valves 16. However, it should be understood that the lash adjusters 100, 102 may or may not have the orifices 69 dependent upon the internal design used.

A plug 120 is connected to the actuator head 20 and is sealingly fitted into the bore 50 at an upper end 124 of the body 30 in any suitable manner, such as by threading or press fitting and/or by retainer plates 125 secured to the actuator head 20 by bolts 127. A cavity 130 forming a part of the bore 50 is defined between the plug 120 and the plunger surface 58. It should be understood that although a plug 120 is shown fitted within the bore 50 to define the plunger cavity 130, the cylinder head 14 may be sealingly fitted against the bore 50. Therefore, the plunger cavity 130 would be defined between the cylinder head 14 and the plunger surface 58.

A first means 140 for selectively communicating fluid from the high pressure fluid source 28 into the plunger cavity 130 is provided for urging the plunger 54 toward the second position. The first communicating means 140 includes means 144 defining a primary flow path 148 between the high pressure fluid source 28 and the plunger cavity 130 during initial movement toward the second position. The means 144 further defines a secondary flow path 152 between the high pressure fluid source 28 and the plunger cavity 130 during terminal movement toward the second position.

A control valve, preferably a spool valve 156A, communicates fluid through the high pressure rail passage 24A and into the primary and secondary flow paths 148, 152. The spool valve 156A is biased to a first position P1 by a pair of helical compression springs (not shown) and moved against the force of the springs (not shown) to a second position P2 by an actuator 158A. The actuator 158A may be of any suitable type, however, in this embodiment the actuator 158A is a piezoelectric motor. The piezoelectric motor 158A is driven by a control unit 159 which has a conventional on/off voltage pattern.

The primary flow path 148 of the first communicating means 140 includes an annular chamber 160 defined between the body 30 and the actuator head 20. A main port 164 is defined within the body 30 in fluid communication with the annular chamber 160 and has a predetermined diameter. An annular cavity 168 is defined between the plunger 54 and the body 30 and has a predetermined length and a predetermined position relative to the main port 164. The annular cavity 168 is in fluid communication with the main port 164 during a portion of the plunger 54 movement between the first and second positions. A passageway 170 is disposed within the plunger 54 and partially traverses the annular cavity 168 for fluid communication therewith.

A first check valve 174 is seated within a bore 176 in the plunger 54 and has an orifice 178 therein in fluid communication with the passageway 170. The first check valve 174 has an open position and a closed position and the orifice 178 has a predetermined diameter.

A stop 180 is seated within another bore 182 in the plunger 54 and is disposed a predetermined distance from the first check valve 174. The stop 180 has an axially extending bore 184 for fluidly communicating the orifice 178 with the plunger cavity 130 and a relieved outside diameter. A return spring 183 is disposed within the first check valve between the valve 174 and the stop 180.

The secondary flow path 152 of the first communicating means 140 includes a restricted port 190 which has a diameter less than the diameter of the main port 164. The restricted port 190 fluidly connects the annular chamber 160 to the annular cavity 168 during a portion of the plunger 54 movement between the first and second positions.

A second means 200 for selectively communicating fluid exhausted from the plunger cavity 130 to the low pressure fluid source 26 in response to the helical springs 18 is provided for urging the plunger 54 toward the first position. The second communicating means 200 includes means 204 defining a primary flow path 208 between the plunger cavity 130 and the low pressure fluid source 26 during initial movement from the second position toward the first position. The means 144 further defines a secondary flow path 210 between the plunger cavity 130 and the low pressure fluid source 26 during terminal movement from the second position toward the first position. The spool valve 156A selectively communicates fluid through the primary and secondary flow path 208, 210 and into the low pressure fluid source 26 through the rail passage 24A.

The primary flow path 208 of the second communicating means 200 includes a second check valve 214 seated within a bore 216 in the body 30 with a portion of the second check valve 214 extending into the annular chamber 160. The second check valve 214 has an open and a closed position. A small conical shaped return spring (not shown) is disposed within the second check valve 214. An outlet passage 218 is defined within the body 30 between the second check valve 214 and the plunger 54. The outlet passage 218 provides fluid communication between the plunger cavity 130 and the annular chamber 160 when the second check valve 214 is in the open position during a portion of the plunger 54 movement between the second and the first position.

The secondary flow path 210 of the second communicating means 200 places the orifice 178 in fluid communication with the low pressure source 26 during a portion of the plunger 54 movement between the second and first positions.

A first hydraulic means 230 is provided for reducing the plunger 54 velocity as the valves 16 approach the open position. The first hydraulic means 230 restricts fluid communication to the annular cavity 168 from the high pressure fluid source 28 through the main port 164 during a portion of the plunger 54 movement between the first and second positions and blocks fluid communication to the annular cavity 168 from the high pressure fluid source 28 through the main port 164 during a separate portion of the plunger 54 movement between the first and second positions. A second hydraulic means 240 is provided for reducing the plunger 54 velocity as the valves 16 approach the closed position. The second hydraulic means 240 includes the frusto-conical shaped second end 62 of the plunger 54 for restricting fluid communication to the low pressure fluid source 26 from the plunger cavity 168 through the outlet passage 218 and for blocking fluid communication to the low pressure fluid source 26 from the plunger cavity 168 through the outlet passage 218.

INDUSTRIAL APPLICABILITY

For increased understanding, the following sequence begins with the plunger 54 in the first position, and therefore, the valve in the closed (or seated) position. Referring to FIG. 1, at the beginning of the valve opening sequence, voltage from the control unit 159 is applied to the piezoelectric motor 158A which, in turn, drives the spool valve 156A in a known manner from the first position P1 to the second position P2. Movement of the spool valve 156A from the first position P1 to the second position P2 closes off communication between the low pressure fluid source 26 and the plunger cavity 130 and opens communication between the high pressure fluid source 28 and the plunger cavity 130.

Referring specifically to FIG. 2, during the initial portion of the plunger 54 movement from the first position to the second position, high pressure fluid from the high pressure fluid source 28 is communicated to the plunger cavity 130 through the primary flow path 148. The high pressure fluid unseats the first check valve 174, allowing the majority of high pressure fluid to rapidly enter the plunger cavity 130 around the first check valve 174 through the relieved outside diameter of the stop 180.

As the plunger cavity 130 fills with high pressure fluid, the plunger 54 moves rapidly downward opening the valves 16 against the force of the springs 18. As the plunger 54 moves downward, the position of the annular cavity 168 in relation to the main port 164 constantly changes. The downward motion of the annular cavity 168 allows fluid connection between the annular cavity 168 and the restricted port 190, thereby allowing high pressure fluid to enter the plunger cavity 130 through both the primary and secondary flow paths 148, 152.

As seen in FIG. 3, when the annular cavity 168 moves past the main port 164 in the terminal portion of the plunger movement fluid communication is restricted and eventually blocked by the outer periphery of the plunger 54 so that all fluid communication between the high pressure fluid source 28 and the plunger cavity 130 is through the restricted port 190. Since the diameter of the restricted port 190 is smaller than the main port 174, downward motion of the plunger 54 is slowed, thereby reducing the velocity of the valve 16 as it reaches a fully open position.

As the annular cavity 168 moves past the restricted port 190, fluid communication is restricted and eventually blocked by the outer periphery of the plunger 54 which allows the plunger 54 to hold the valve 16 at its maximum lift position. As leakage occurs within the system, the plunger 54 will move up and slightly re-open the restricted port 190 and, therefore, recharge the plunger cavity 130 causing the plunger 54 to move back down. The valve 16 open position is then stabilized around the maximum lift position by the small movements of the plunger 54 opening and closing the restricted port 190. During this time, the return spring 183 on the first check valve 174 returns the valve 174 to its seat. It should be understood that the restricted port 190 may not be necessary dependent upon specific designs which would accomplish rapid stopping of the plunger 54 at maximum lift, such as utilizing a plunger 54 with a larger diameter or higher forces on the springs 18.

Referring again to FIG. 1, to begin the valve closing sequence, voltage from the control unit is removed from the piezoelectric motor 158A which, in turn, allows the spool valve 156A to return in a known manner from the second position P2 to the first position P1. Movement of the spool valve 156A from the second position P2 to the first position P1 closes off communication between the high pressure fluid source 28 and the plunger cavity 130 and opens communication between the low pressure fluid source 26 and the plunger cavity 130. At this stage, the potential energy of the springs 18 is turned into kinetic energy in the upwardly moving exhaust valve 16.

Referring more specifically to FIG. 3, the high pressure fluid within the plunger cavity 130 unseats the second check valve 214 since low pressure fluid is now within the annular chamber 160. The unseating of the second check valve 214 allows the majority of fluid within the plunger cavity 130 to rapidly return to the low pressure fluid source 26 through the primary flow path 208. A portion of the high pressure fluid within the plunger cavity 130 is returned to the low pressure fluid source 26 through the secondary flow path as the orifice 178 fluidly connects with the annular chamber 160 during the terminal plunger 54 movement from the second position to the first position.

As the second end 62 of the plunger 54 having the frusto-conical shape 64 moves past the outlet passage 218, fluid communication to the low pressure fluid source 26 is gradually restricted and eventually blocked, reducing the velocity of the valve 16 as it reaches its closed or seated position. Once the outlet passage 218 is completely blocked, fluid communication from the plunger cavity 130 to the low pressure fluid source 26 is only through the orifice 178, as can be seen in FIG. 2. The fluid communication occurs only through the orifice 178 because the first check valve 174 is seated, allowing substantially no additional fluid communication around the first check valve 174. Therefore, final seating velocity is more finely controlled by the size of the small diameter of the orifice 178.

Additionally, when the spool valve 156A is in the P1 position and connected with the low pressure fluid source 26, fluid is communicated to the hydraulic adjusters 100, 102 through the orifices 69. The orifices 69 communicate with the passages 70 to control the maximum pressure allowed for the lash adjusters 100, 102. However, when the spool valve moves into the P2 position, the plunger 54 is moved downwards and the orifice 80 moves past the cross bore 84 restricting and eventually blocking fluid communication from the low pressure fluid source 26 to the adjusters 100, 102.

Figure 5:
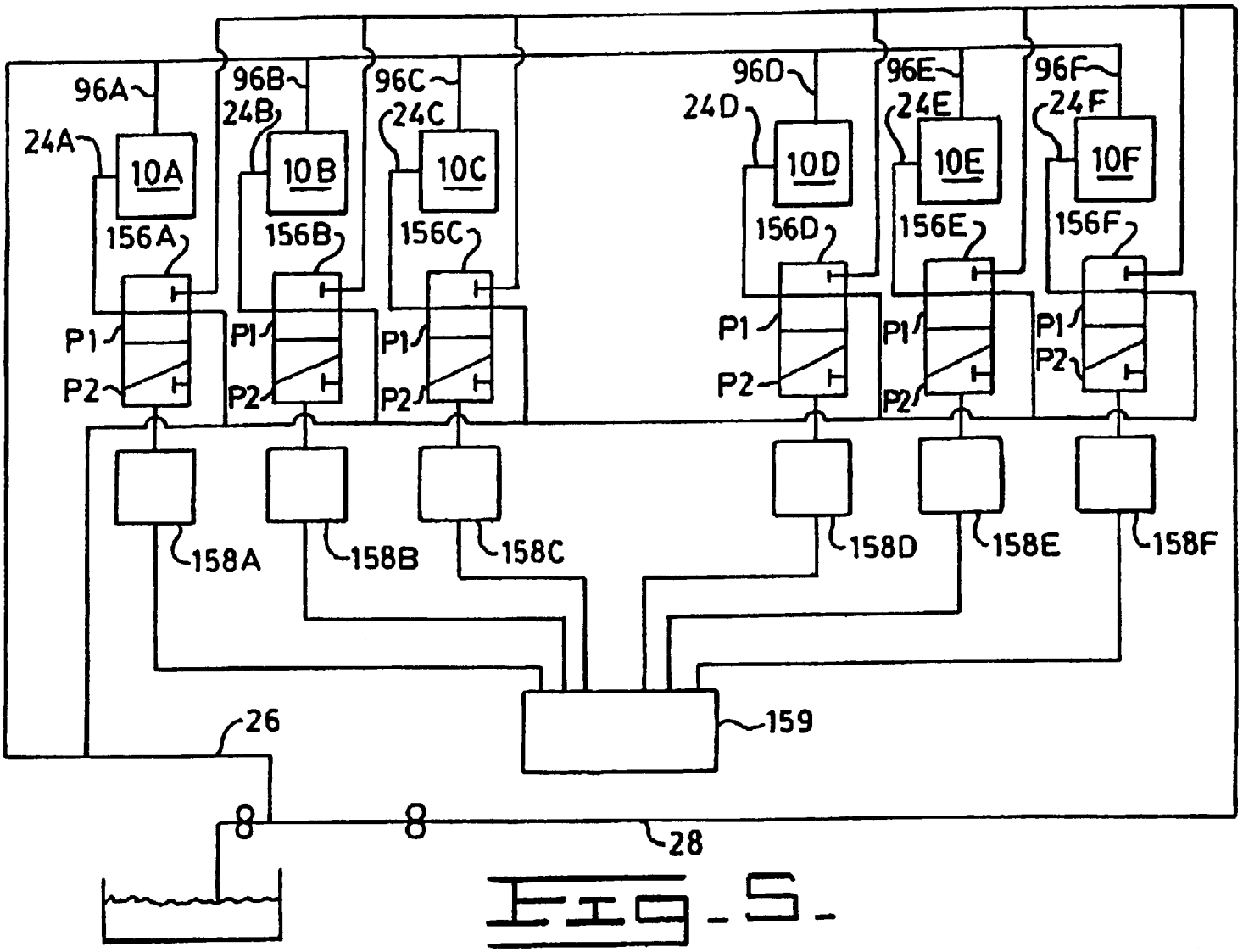
FIG. 5 is a block diagram of an exhaust valve actuation system for use with a six cylinder engine capable of carrying out the method of the present invention.
Figure 6:
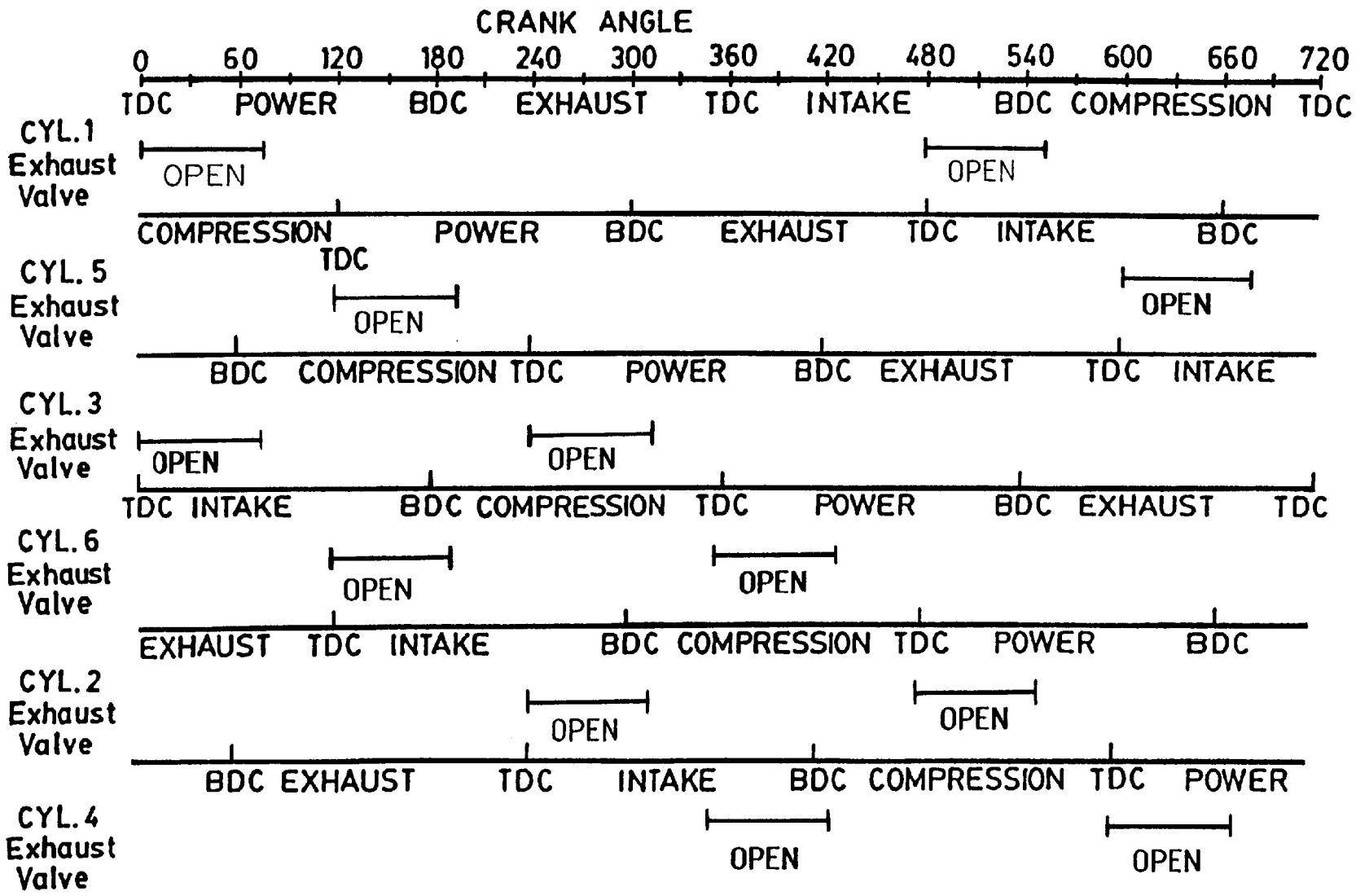
FIG. 6 is a table showing the timing of exhaust valve opening for each cylinder of the system of FIG. 5 during a braking mode of operation in accordance with the method of the present invention.
Figure 7:
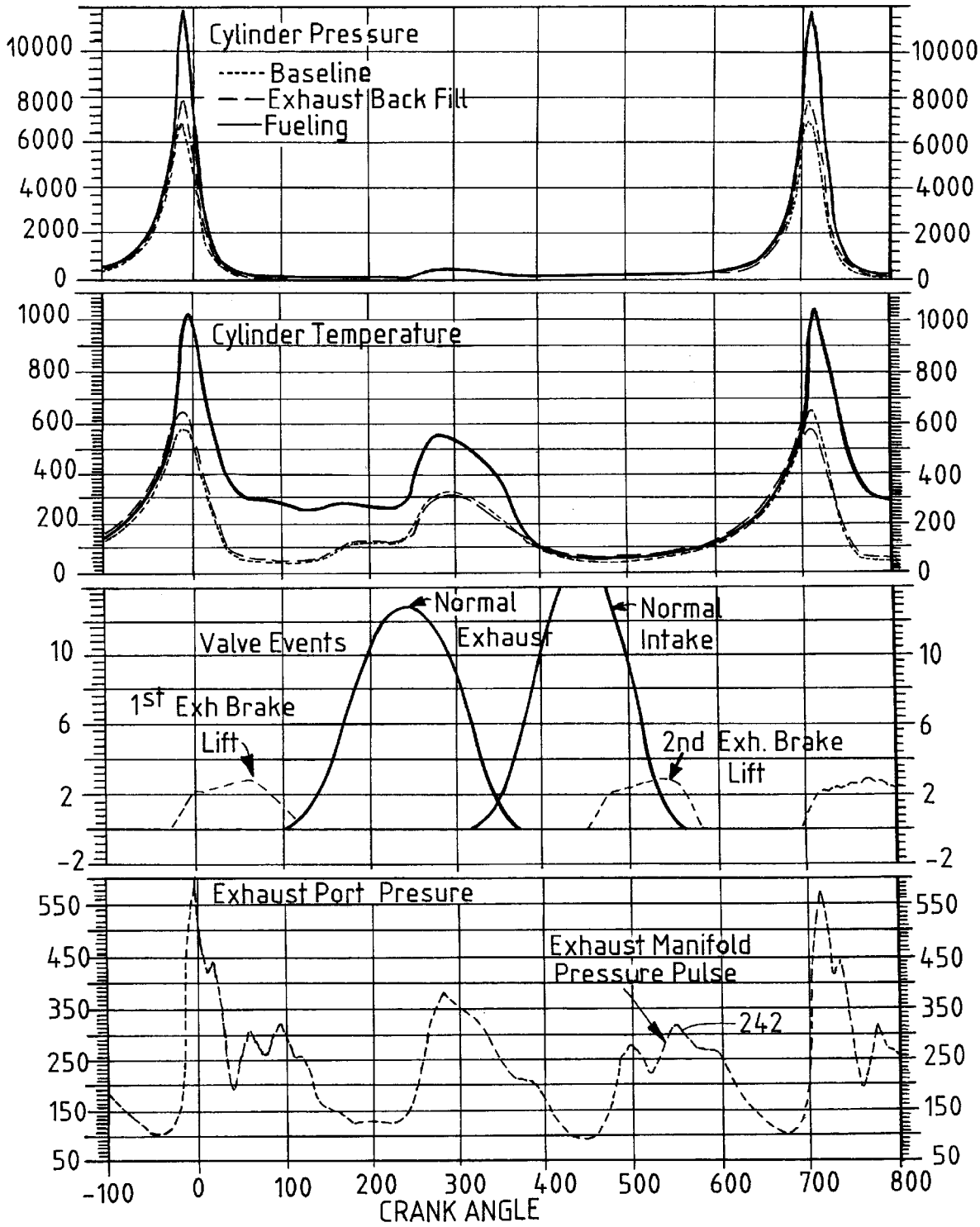
FIG. 7 is a plot depicting simulation results illustrating the braking mode of operation in accordance with the present invention, and showing combustion chamber pressure, combustion chamber temperature, valve events and exhaust port pressure as a function of crank angle (a fueling graph is indicated by the solid line, an exhaust back fill is indicated by the section line symbol and the baseline is indicated by the hidden line symbol).

Now referring to FIGS. 5 through 7, when braking is desired, the engine is converted to a braking mode in which the normal intake and exhaust valve events are preferably disabled, or alternatively, may continue to occur (i.e., if a camactuated valve opening mechanism is used for normal intake and exhaust valve events), and in which each exhaust valve 16 is opened by about 2 mm at a first time when the cylinder 11A, 11B, 11C, 11D, 11E or 11F associated with the exhaust valve 16 is at the beginning of the power portion of the cycle of operation (i.e., when the associated piston (not shown) is at TDC, depicted in FIGS. 6 and 7 for cylinder 1 as a crank angle of zero degrees), and is preferably held open for about 80 degrees of crank angle. As a result, the exhaust port pressure in the exhaust manifold 13 is elevated due to a pressure pulse 242 (FIG. 7) caused by the opening of each exhaust valve 16 at the beginning of the power portion of the cycle of operation.

In addition, each exhaust valve 16 is opened by about 2 mm at a second time when the cylinder 11A, 11B, 11C, 11D, 11E or 11F associated with the exhaust valve 16 is at the end of the intake portion of the cycle of operation (i.e., when the associated piston (not shown) is at about 60 degrees before BDC, depicted in FIGS. 6 and 7 for cylinder 1 as a crank angle of 480 degrees), and is again preferably held open for about 80 degrees of crank angle.

The timing and duration of the opening of each exhaust valve is dictated by the control unit 159 that sends a signal to each piezoelectric motor 158A, 158B, 158C, 158D, 158E or 158F (associated with the appropriate cylinder 11A through 11F, respectively). Each piezoelectric motor 158A–E in turn, drives the corresponding spool valve 156A, 156B, 156C, 156D, 156E or 156F from the first position P1 to the second position P2, to in turn operate the corresponding valve actuation system 10A, 10B, 10C, 10D, 10E or 10F as discussed above with regard to FIG. 1.

As seen in FIG. 6, during the braking mode in accordance with the method of the present invention, the first and second opening events coincide with one another as follows: the cylinder 1 first opening event coincides with the cylinder 3 second opening event; the cylinder 5 first opening event coincides with the cylinder 6 second opening event; the cylinder 3 first opening event coincides with the cylinder 2 second opening event; the cylinder 6 first opening event coincides with the cylinder 4 second opening event; the cylinder 2 first opening event coincides with the cylinder 1 second opening event; and the cylinder 4 first opening event coincides with the cylinder 5 second opening event. Thus, for each of the foregoing pairs of cylinders, the pressure in the cylinder undergoing the second opening event will increase as a result of the pressure pulse 242 provided by the cylinder undergoing the first opening event.

Numerous modifications and alternative embodiments of the invention will be apparent to those skilled in the art in view of the foregoing description. Accordingly, this description is to be construed as illustrative only and is for the purpose of teaching those skilled in the art the best mode of carrying out the invention. The details of the structure may be varied substantially without departing from the spirit of the invention, and the exclusive use of all modifications which come within the scope of the appended claims is reserved. For example, the foregoing description was primarily directed to an apparatus capable of carrying out a method in accordance with the present invention utilizing an electronically controlled hydraulic valve actuation system. However, as those skilled in the art will recognize, the method in accordance with the present invention can be practiced with any suitable apparatus.

What is claimed is:

1. A method of compression braking of an internal combustion engine, the engine having a plurality of combustion chambers, each combustion chamber operating in a cycle comprising intake, compression, power and exhaust portions, each combustion chamber being in flow communication with an exhaust valve movable between an open position and a closed position for selectively placing each combustion chamber in flow communication with a common exhaust manifold, the method comprising the steps of:

moving each exhaust valve to the open position at a first time corresponding to approximately the beginning of the power portion of the cycle of the combustion chamber associated with the exhaust valve; and moving each exhaust valve to the open position at a second time corresponding to approximately the end of the intake portion of the cycle of the combustion chamber associated with the exhaust valve;

wherein each portion of the cycle of the internal combustion engine comprises 180 degrees of crank angle rotation and wherein the step of moving each exhaust valve to the open position at the first time includes a step of holding the exhaust valve open from approximately the beginning of the power portion of the cycle of the combustion chamber associated with the exhaust valve to a crank angle of about 80 degrees after the beginning of the power portion of the cycle of the combustion chamber associated with the exhaust valve.

2. The method of claim 1, wherein the step of moving each exhaust valve to the open position at the second time includes a step of holding the exhaust valve open from a crank angle of about 120 degrees after the beginning of the intake portion of the cycle of the combustion chamber associated with the exhaust valve to a crank angle of about 30 degrees after the beginning of the compression portion of the cycle of the combustion chamber associated with the exhaust valve.

3. A method of compression braking of an internal combustion engine, the engine having a plurality of combustion chambers, each combustion chamber operating in a cycle comprising intake, compression, power and exhaust portions, each combustion chamber being in flow communication with an exhaust valve movable between an open position and a closed position for selectively placing each combustion chamber in flow communication with a common exhaust manifold, the method comprising the steps of:

moving each exhaust valve to the open position at a first time corresponding to approximately the beginning of the power portion of the cycle of the combustion chamber associated with the exhaust valve; and moving each exhaust valve to the open position at a second time corresponding to approximately the end of the intake portion of the cycle of the combustion chamber associated with the exhaust valve;

wherein each portion of the cycle of the internal combustion engine comprises 180 degrees of crank angle rotation and wherein the step of moving each exhaust valve to the open position at the second time includes a step of holding the exhaust valve open from a crank angle of about 120 degrees after the beginning of the intake portion of the cycle of the combustion chamber associated with the exhaust valve to a crank angle of about 30 degrees after the beginning of the compression portion of the cycle of the combustion chamber associated with the exhaust valve.

* * * * *